US008662359B1

(12) United States Patent
Hickey

(10) Patent No.: US 8,662,359 B1
(45) Date of Patent: Mar. 4, 2014

(54) GASOLINE CAN AIR VENT

(76) Inventor: James R. Hickey, Ashland, MA (US)

( * ) Notice: Subject to any disclaimer, the term of this patent is extended or adjusted under 35 U.S.C. 154(b) by 251 days.

(21) Appl. No.: 13/114,302

(22) Filed: May 24, 2011

Related U.S. Application Data

(60) Provisional application No. 61/397,863, filed on Jun. 18, 2010.

(51) Int. Cl.
*B67D 7/06* (2010.01)

(52) U.S. Cl.
USPC ..... 222/484; 222/534; 220/745

(58) Field of Classification Search
USPC ..... 222/484, 478, 558, 559, 560, 561, 563, 222/534, 129; 220/203.6, 220, 705, 709, 220/745
See application file for complete search history.

(56) References Cited

U.S. PATENT DOCUMENTS

| | | | | |
|---|---|---|---|---|
| 2,839,227 | A * | 6/1958 | Wilson et al. | 222/484 |
| 2,979,238 | A * | 4/1961 | Bramming | 222/484 |
| 4,273,265 | A * | 6/1981 | Anderson | 222/189.01 |
| 4,946,079 | A * | 8/1990 | Campbell | 222/484 |
| 5,797,521 | A * | 8/1998 | Sobral | 222/531 |
| 6,026,994 | A * | 2/2000 | Rigel | 222/538 |
| 6,155,464 | A * | 12/2000 | Vachon | 222/484 |
| 6,230,944 | B1 * | 5/2001 | Castellano et al. | 222/481.5 |
| 6,360,924 | B1 * | 3/2002 | Franzen | 222/468 |
| 6,793,104 | B2 * | 9/2004 | Kao | 222/481.5 |
| 7,204,394 | B2 * | 4/2007 | Tackett | 222/561 |
| 7,802,704 | B2 * | 9/2010 | Hatch et al. | 222/534 |
| 2005/0076616 | A1 * | 4/2005 | Bassett et al. | 53/432 |
| 2008/0237233 | A1 * | 10/2008 | Choi et al. | 220/212.5 |
| 2009/0032556 | A1 * | 2/2009 | Zwahlen | 222/534 |
| 2010/0308085 | A1 * | 12/2010 | Vachon | 222/484 |

* cited by examiner

*Primary Examiner* — Paul R Durand
*Assistant Examiner* — Donnell Long
(74) *Attorney, Agent, or Firm* — Chapin IP Law, LLC

(57) ABSTRACT

Methods and apparatus provide for a gasoline can air vent apparatus. The gasoline can air vent apparatus includes a platform having a platform fuel passage and a platform air channel. A nozzle assembly is in removable-mechanical communication with the platform. The nozzle assembly includes a nozzle assembly air channel substantially aligned with the platform air channel. A nozzle fuel channel extends into the nozzle assembly. A nozzle air channel extends into the nozzle assembly.

6 Claims, 5 Drawing Sheets

GASOLINE CAN AIR VENT

PRIORITY TO PROVISIONAL APPLICATION

This U.S. Utility patent Application claims the benefit of the filing date of earlier filed U.S. Provisional Application for patent having U.S. Ser. No. 61/397,863, filed Jun. 18, 2010 entitled "GASOLINE CAN AIR VENT." The entire teaching, disclosure and contents of this provisional patent are hereby incorporated by reference herein in their entirety.

BACKGROUND

Portable containers for the transport of liquid fuel are commonly referred to as gasoline cans. Currently gasoline cans are generally made of blow molded plastic and have nozzles which are separable therefrom in which the nozzles can be positioned back within the gasoline can orifice during storage of the gasoline can. Recent developments in gasoline can technology provide means to prevent escape of VOCs into the atmosphere. In practice many trades people who use portable gasoline cans often leave them after use with their nozzles attached and facing upwards without capping them to prevent VOCs from being released into the atmosphere. The need to prevent of the escape of VOCs from gasoline cans is urgent, and many regulatory organizations such as the California Air Research Bureau have formulated specifications for gasoline cans to assure that they do not emit VOCs into the atmosphere. These regulations are being adopted by more and more states.

Current gasoline cans are derived from the old, metal "Jerry cans" that were used in WWII, but today's gasoline cans are composed of high-density polyethylene rather than of metal. Thus they are very rugged and impervious to the constituent elements of gasoline, kerosene and diesel fuel. Gasoline cans are available in different sizes, such as 2.5 gallon and 5 gallon cans. In recent years they have been color-coded to reflect their contents where a red can indicates that it contains gasoline; a yellow can, diesel fuel; and a blue can, kerosene.

Portable gasoline cans are used by home owners, for example, to fill lawn mowers; and such use accounts for a significant amount of VOC emissions escaping into the air. According to calculations from the U.S. Environmental Protection Agency, emissions from gasoline cans contribute approximately 22.4 tons of volatile organic compounds (VOCs) per day just in the Chicago metropolitan area. VOC emissions from gasoline cans can also occur due to evaporation and from fuel spillage; therefore it is desirable to have a gasoline can that includes shutoff means for preventing fuel evaporation and inadvertent spillage.

Such fuel dispensing cans must have an air vent to allow air to enter the can while the fuel is exiting the can so as to prevent a vacuum lockup which would prevent the fuel from easily exiting the gasoline can. Most prior art gasoline cans are somewhat rectangular or cylindrical in configuration and have an openable air vent usually disposed in the can wall generally opposite the positioning of the spout. The vent often has an openable and closeable cap that is often held on the vent by friction fit and, when opened, is retained to the vent by a tether. The vent is capped when closed to prevent the escape of VOCs. When one pours fuel from such gasoline can, one opens the vent to allow air to pass therethrough into the gasoline can to replace the volume of fluid as it exits the can through the spout.

SUMMARY OF THE INVENTION

It is an object of this invention to provide a new type of air vent for a gasoline can that eliminates the need for air vents that pass through the gasoline can wall. The air vent of this invention is located within the nozzle in the gasoline can of our new design, such as taught in our U.S. Pat. No. D608,855 which has a nozzle that extends from a rotatable ball valve that in a first position is closed and thus seals the fuel in the can; and in a second use position, such nozzle is rotated to an open position to allow the fuel to pass from the can. Within the nozzle and can is located the structure that comprises the improved air vent of this invention. The air vent of this invention is generally a channel structure extending within the nozzle and has an opening adjacent to the fuel passage opening within the ball valve of the nozzle structure. In the can structure is a nozzle receipt platform onto which the nozzle structure is engaged which then aligns, as described below, the can's fuel passage with the nozzle assembly fluid channel opening. At the same time that the nozzle fuel channel opening aligns with the fuel opening in the nozzle structure and the platform fuel passage, the nozzle air channel opening aligns with the tube air channel opening in the nozzle assembly such that air can pass from the exterior opening of the nozzle where the air channel is exposed to the atmosphere and air can pass directly through the nozzle air channel to the platform air channel which is engaged to a tube that extends within the can to an area at the opposite side from the nozzle such that air entering the nozzle air channel will enter the can in the area away from the fuel exiting the can which fuel has flowed within the can to the point where the fuel is passing out of the can through the nozzle fuel channel which is positioned substantially adjacent to and partially around the nozzle air channel. In the embodiment illustrated herein, the can has a top handle and a side handle. When the can is placed on its bottom, the top handle is positioned at the uppermost portion of the gasoline can and the tube can be extended from the air channel within the top handle which is hollow to a point near the back end of the gasoline can. When the gasoline can is tipped to pour the fuel, the side handle can be used to hold the can as the side handle then is maneuvered to a more uppermost position and the end of the tube extends to a point higher than the top level of the fluid so as to allow the air venting to occur with the air entering the can through the nozzle tip and replacing the volume of fluid that has passed out of the can through the nozzle fuel channel with an equal volume of air.

DESCRIPTION OF THE PREFERRED EMBODIMENT(S)

Figure 1:
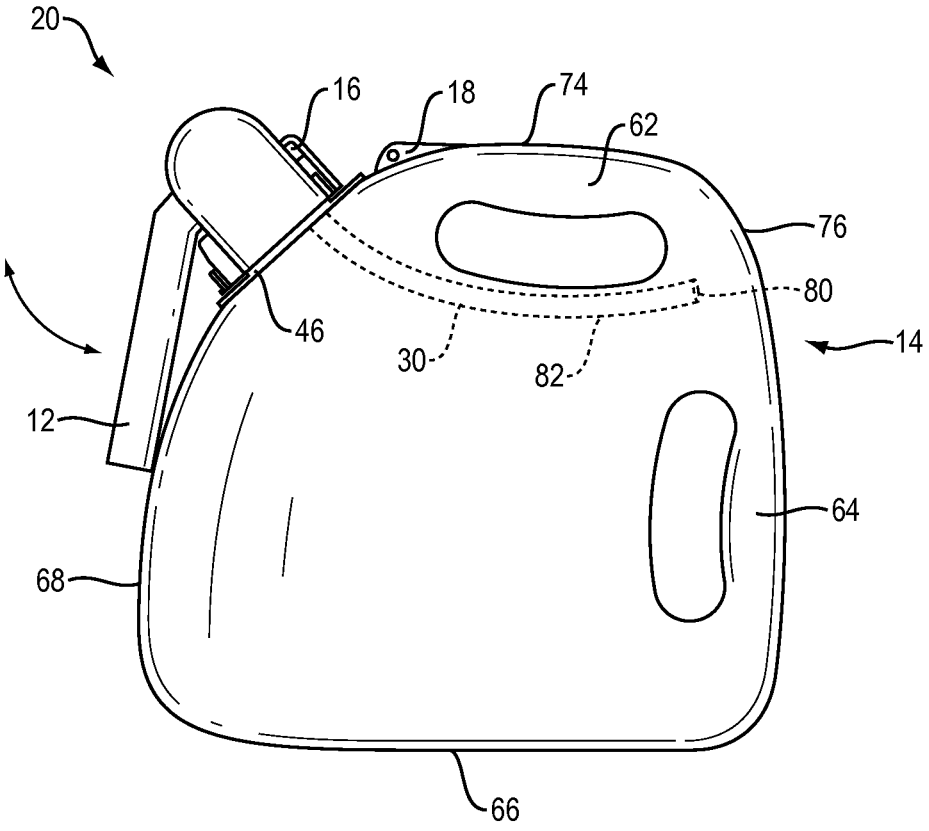
FIG. 1 illustrates a side view of the gasoline can having the air vent assembly of this invention.
Figure 2:
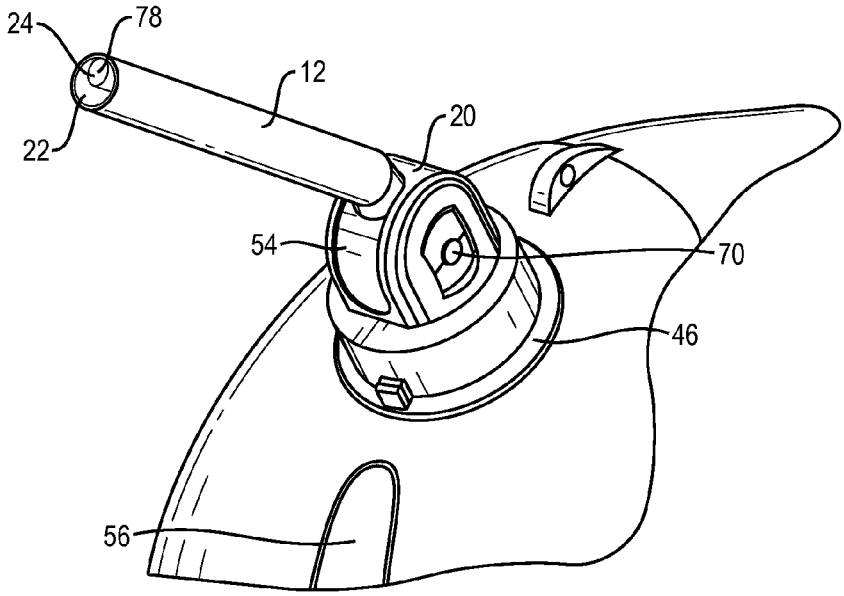
FIG. 2 illustrates an enlarged perspective view of the nozzle in an open position showing the exterior end of the nozzle air channel.
Figure 3:
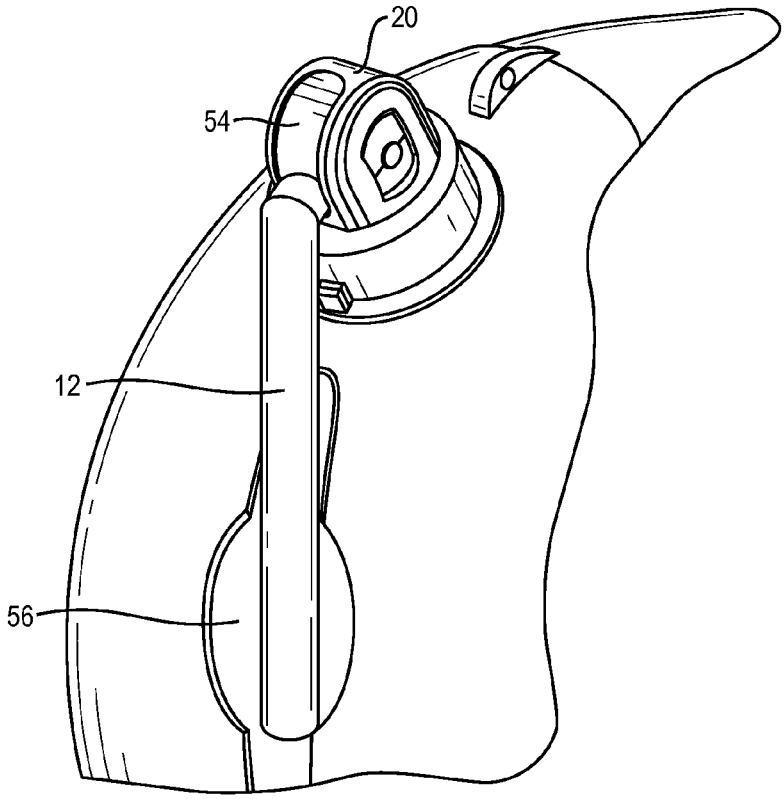
FIG. 3 illustrates an enlarged perspective view of the nozzle of FIG. 2 in a closed position.
Figure 4:
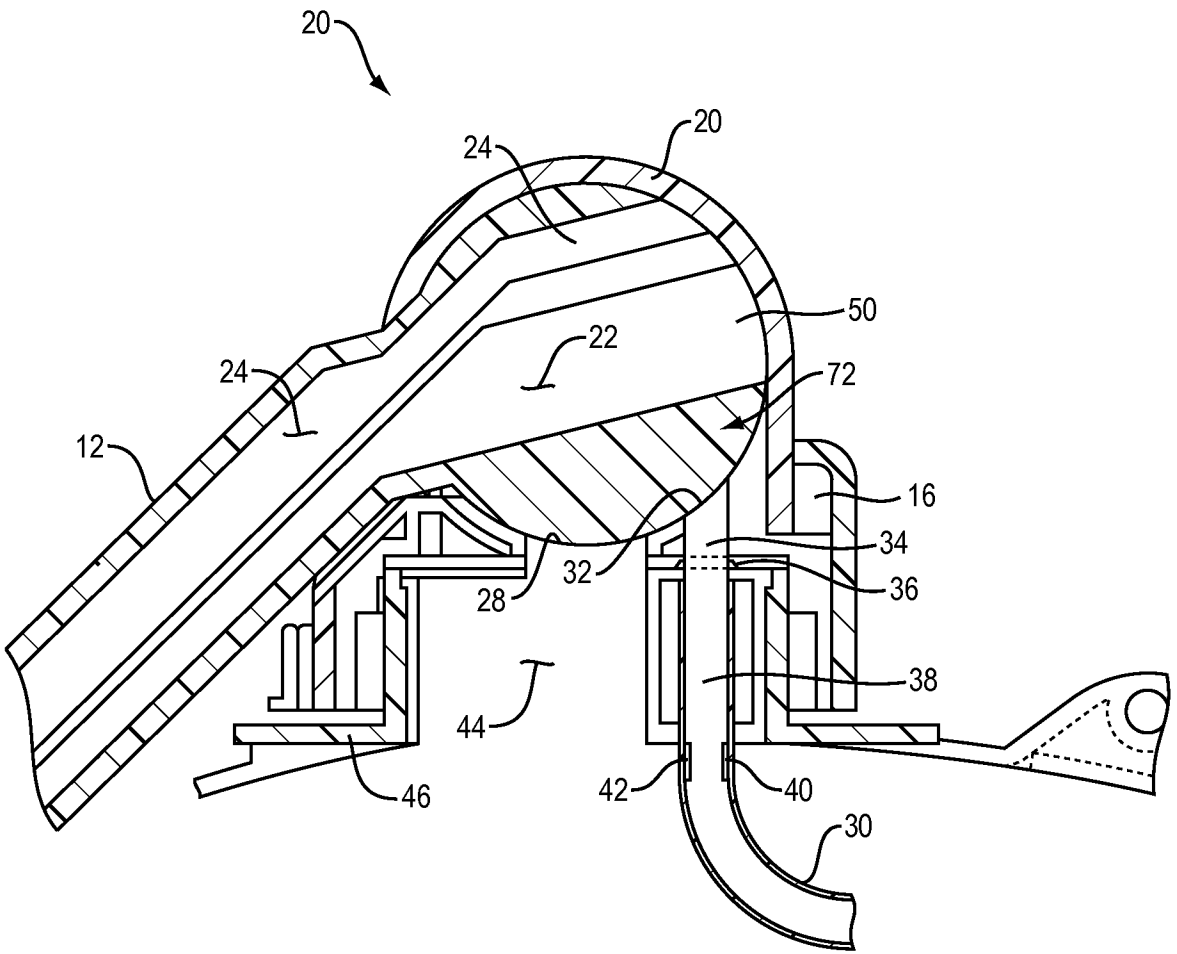
FIG. 4 illustrates an enlarged side cutaway view of the nozzle assembly in its closed mode mounted on the platform of the gasoline can and showing the tube extending therefrom but not showing the rest of the gasoline can.
Figure 5:
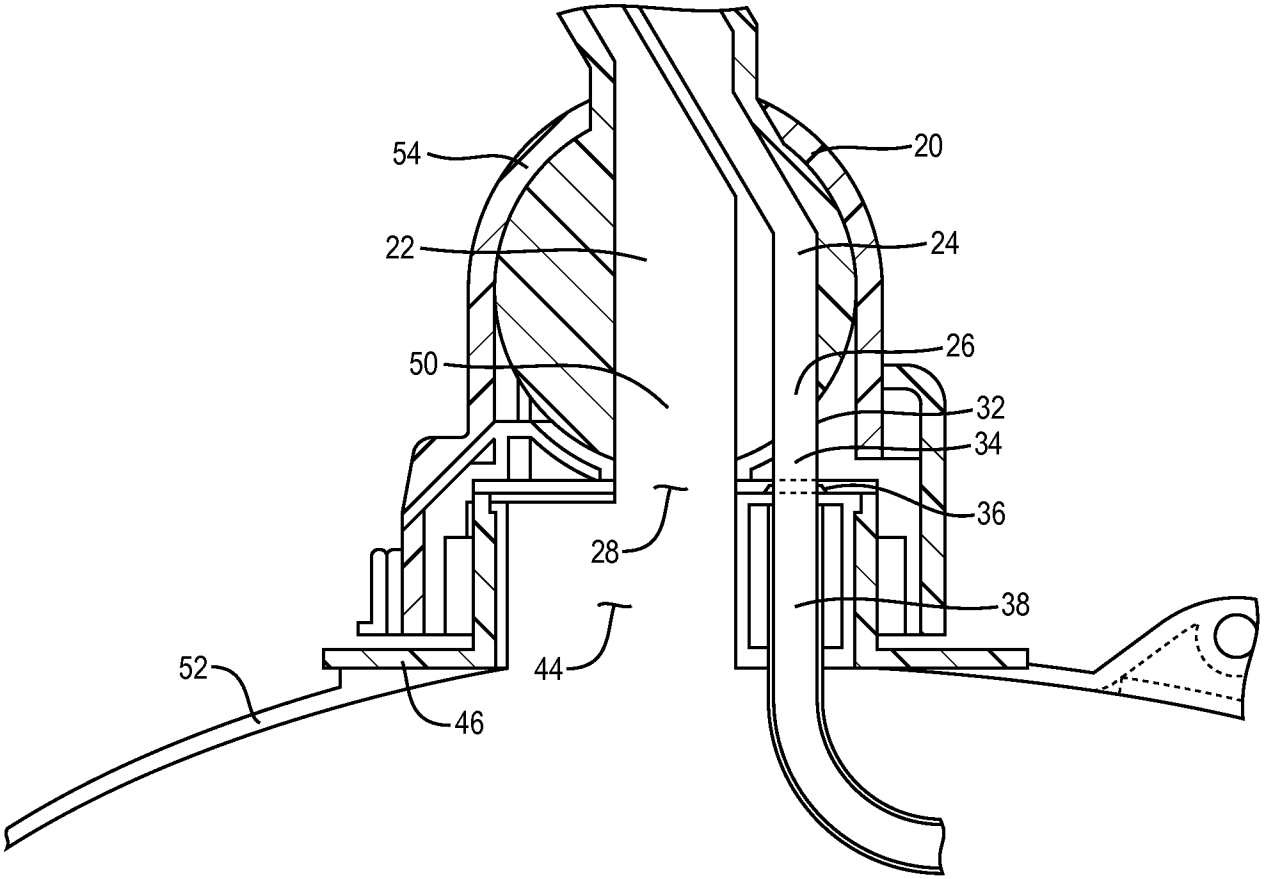
FIG. 5 illustrates an enlarged side cutaway view of the nozzle assembly of FIG. 4, showing the nozzle assembly in its open mode.
Figure 6:
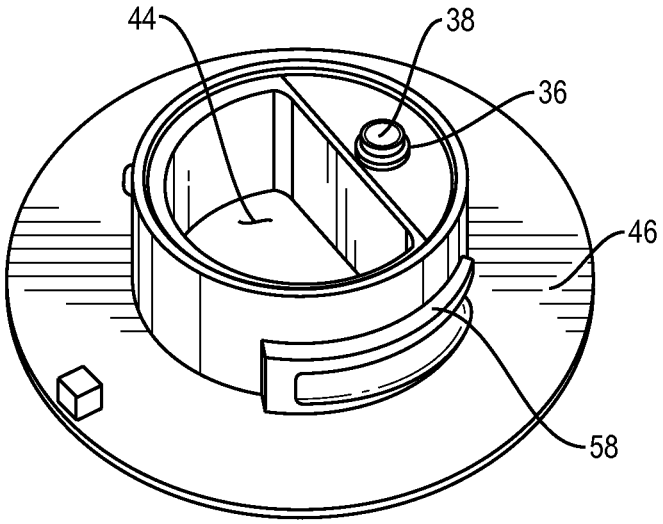
FIG. 6 illustrates a perspective view of the platform onto which the nozzle assembly would be engaged but not showing the attached gasoline can.

FIG. 1 illustrates a side view of gasoline can 14 in which air vent 82 of this invention can be utilized. In FIGS. 1 and 5 can be seen gasoline can top 74, rear side 76, front side 68 having upper portion 52, bottom 66, can tether retention aperture 18, nozzle assembly tether retention aperture 16, top handle 62 and side handle 64. In its upright storage position gasoline can 14 can rest on its bottom 66 on the ground and in its use mode when the can is lifted by side handle 64, bottom 66 is disposed perpendicular to the ground. In use, one grasps side handle 64 of gasoline can 14 which is tipped, maneuvering nozzle assembly 20 and nozzle 12 toward the object into which the fuel contained within the can 14 is to be poured such that front side 68 is disposed to be more parallel to the ground and side handle 64 then becomes the uppermost handle, then being the easier handle to hold in order to manipulate the end of nozzle 12 to its desired pouring position. Nozzle 12 within nozzle assembly 20 is seen in FIGS. 1 and 3 in its downward storage position within nozzle receipt cavity 56 formed in front side 68 of can 14, as seen in FIG. 3, after it has been rotated on trunnion 70, shown in FIG. 2. When can 14 is to be used in its fuel-dispensing mode, nozzle 12 is rotated upwards within nozzle slot 54, as seen in FIGS. 2 and 5, to its upright position which position aligns nozzle fuel channel 22 with fuel opening 28 such that nozzle assembly fuel channel opening 50 aligns with platform fuel passage 44, as seen in FIGS. 5 and 6, allowing fuel from within can 14 to pass outward through fuel opening 28 and out nozzle fuel channel 22. When nozzle 12 is maneuvered downward back to its storage mode, ball valve 72, as seen in FIG. 4, rotates within a portion of nozzle assembly 20 to where it is blocked, with a portion of ball valve 72 covering fuel opening 28, thus sealing the can and preventing further fuel from exiting. Disposed on can 14 is platform 46, shown attached to can 14 in FIG. 1, and shown separated from the can for purposes of illustration in FIG. 6. Nozzle assembly 20 threads onto a protruding portion of platform 46 by screwing onto engagement thread 58. Seen in FIG. 6 is platform fuel passage 44 and also the open end of platform air channel 38 having an air channel gasket 36 around the end thereof. Within nozzle assembly 20 is located a nozzle assembly air channel 34 having a tube air channel opening 32 defined at the first end thereof adjacent to ball valve 72, as seen in FIG. 4. When nozzle assembly 20 is screwed onto platform 46, nozzle assembly air channel 34 can be aligned with platform air channel 38 and is sealed thereto by air channel gasket 36 when valve 72 is in its open mode. At the bottom of platform air channel 38 is tube receipt member 40 onto which is attached tube engagement member 42 which extends to tube 30. Tube 30 can extend within top handle 62 toward can rear side 76 or be disposed within can 14, as seen in FIG. 1.

To add fuel to gasoline can 14, one removes nozzle assembly 20 which has nozzle assembly tether retention aperture 16 which can be secured by a tether, not shown, to can tether retention aperture 18, as seen in FIG. 1, and pours fuel through platform fuel passage 44. When the fuel is in can 14, one then screws nozzle assembly 20 onto platform 46 which aligns nozzle assembly air channel 34 to platform air channel 38, as seen in FIG. 4. When nozzle assembly 20 is in a closed position, as seen in FIG. 4, portions of ball valve 72 block both fuel opening 28 and tube air channel opening 32. To place nozzle assembly 20 in its open mode for pouring fuel form gasoline can 14, one lifts up nozzle 12, which action rotates ball valve 72, causing nozzle assembly fuel channel opening 50 to align with fuel opening 28 and causing nozzle air channel 24 to align with platform air channel 38, as seen in FIG. 5. In this use mode, fuel can leave can 14 by traveling down nozzle fuel channel 22 to the desired location of pouring while at the same time air can pass into nozzle air channel 24, the exterior entrance 78 of which is seen in FIG. 2. The air passes through nozzle air channel 24, through nozzle air channel opening 26, through nozzle assembly air channel 34, through platform air channel 38 into tube 30 where the air can exit through air exit 80 at the interior end of tube 30 within can 14 near rear side 76. In this way, as fuel is exiting through raised nozzle 12, air is also entering through nozzle air channel 24 in nozzle 12 to replace the volume of fluid leaving can 14 to promote the easy flow of fluid out of gasoline can 14.

Although the present invention has been described with reference to particular embodiments, it will be apparent to those skilled in the art that variations and modifications can be substituted therefor without departing from the principles and spirit of the invention.

What is claimed is:

1. A portable container for storing and transporting fuel, the fuel including volatile organic compounds, comprising:

a fuel container portion including a top, a bottom, and four sides including a front side having an upper portion;

a platform including a platform fuel passage and a platform air channel, the platform fuel passage and the platform air channel being in fluid communication with the fuel container portion;

a nozzle assembly in removable-mechanical communication with the platform, the nozzle assembly including an adjustable nozzle assembly portion including a ball valve, and a nozzle assembly air channel substantially aligned with the platform air channel, wherein the platform is operative to couple the nozzle assembly to the upper portion of the front side of the fuel container portion;

a nozzle coupled to the ball valve, the nozzle having a length;

a nozzle fuel channel extending along the length of the nozzle and through the ball valve; and a nozzle air channel extending along the length of the nozzle and through the ball valve, wherein the ball valve is operative to rotate to a first position to move the nozzle fuel channel into alignment with the platform fuel passage, and to move the nozzle air channel into alignment with the nozzle assembly air channel, and wherein the ball valve is further operative to rotate to a second position to move the nozzle fuel channel out of alignment with the platform fuel passage, to move the nozzle air channel out of alignment with the nozzle assembly air channel, and, while in the second position, to block and seal the platform fuel passage and the nozzle assembly air channel, thereby substantially preventing escape of the volatile organic compounds from the fuel container portion to the atmosphere through the platform fuel passage and the nozzle assembly air channel.

2. The apparatus as in claim 1, including:

a gasket surrounding at least a portion of the platform air channel, wherein the gasket is operative to form a seal between the nozzle assembly air channel and the platform air channel in response to a movement of the ball valve to the first position.

3. The apparatus as in claim 1, wherein the fuel container portion further includes a container fuel opening and a container air opening, the container fuel opening substantially aligned with the platform fuel passage and the container air opening substantially aligned with the platform air channel, wherein a liquid can be dispensed from an interior of the fuel container portion through the container fuel opening when the ball valve is rotated to the first position.

4. The apparatus as in claim 3, including:

an internal channel disposed within the interior of the fuel container portion, wherein a first end of the internal channel is substantially aligned with the container air opening, wherein air enters into the interior of the fuel container portion via the internal channel when the ball valve is rotated to the first position.

5. The apparatus as in claim 1, wherein the fuel container portion has a shape, the shape including a recessed external surface; and wherein a movement that places the ball valve in the second position rests at least a portion of the nozzle within the recessed external surface.

6. The apparatus as in claim 1, including:

an internal channel disposed within an interior of the fuel container portion, the fuel container portion further including a container fuel opening and a container air opening, the internal channel substantially aligned with the container air opening and the platform air channel, wherein air from an exterior of the fuel container portion enters into the interior of the fuel container portion via the internal channel as a liquid is dispensed through the container fuel opening when the ball valve is rotated at the first position.

* * * * *